United States Patent [19]

Castleman et al.

[11] 4,436,304

[45] Mar. 13, 1984

[54] TENNIS TEACHING AID

[76] Inventors: Bonnie L. Castleman, 43 Ellen La.; Mary Jean, 25 Cliffside Dr., both of Manchester, Conn. 06040

[21] Appl. No.: 275,126

[22] Filed: Jun. 18, 1981

[51] Int. Cl.[3] ..... A63B 61/00

[52] U.S. Cl. ..... 273/29 A; 273/29 BB

[58] Field of Search ..... 273/29 B, 29 R, 29 BB, 273/30, 29 AB, 29 A

[56] References Cited

U.S. PATENT DOCUMENTS

| | | | |
|---|---|---|---|
| 1,534,447 | 4/1925 | Hardy | 273/29 AB |
| 1,959,573 | 5/1934 | Dieball | 273/29 B |
| 3,993,306 | 11/1976 | Scott | 273/29 A |
| 4,160,549 | 7/1979 | Simpson | 273/29 A |

FOREIGN PATENT DOCUMENTS

| | | | |
|---|---|---|---|
| 15914 | of 1888 | United Kingdom | 273/29 B |

*Primary Examiner*—Richard C. Pinkham
*Assistant Examiner*—T. Brown
*Attorney, Agent, or Firm*—McCormick, Paulding & Huber

[57] ABSTRACT

A tennis teaching aid is disclosed for use on a tennis court and to be streteched between two auxiliary net posts in cooperation with or without a standard tennis net. The aid provides a white target band simulating the top band of the standard net but spaced above the top band of the standard net by a variable amount. The aid is releasably attachable to the standard net posts and is quickly and easily put up and taken down, can readily be moved from court to court and is compact so as to be readily storable when not in use.

3 Claims, 7 Drawing Figures

TENNIS TEACHING AID

BACKGROUND OF THE INVENTION

This invention relates to tennis teaching aids and deals more particularly with a device usable on a tennis court in combination with a standard net and net posts to encourage players to hit balls over the net with greater ball-to-net spacing.

In playing tennis, balls hit from one player to another have to pass over the top of the standard net in order to remain in play. The top of the net includes a relatively wide white band or tape which distinctly marks the top edge of the net. Many players unconsciously use this band as a target and in executing various different strokes tend to hit balls over the net with too little spacing between the balls and the net.

A purpose of the invention is therefore to provide a tennis teaching aid providing a visible band located above the top edge of the standard net and serving as a target encouraging players to hit balls with greater ball-to-net spacing. Such greater spacing is important in many aspects of the game and therefore the aid of the invention may be used in instruction and practice by tennis players to develop proper ground stroke technique, utilization and understanding concepts of tennis ball spin, racquet acceleration, ball speed, body lift, shoulder rotation, tennis racquet follow-through, and elevation or trajectory of the tennis ball traveling from base line to base line of the court.

A further object of the invention is to provide a tennis teaching aid of the foregoing character which may be readily set up and taken down as needed, which is readily attachable to standard net posts, wherein the target band may be adjustably tensioned and held at a selected tension through the use of a simple jamb cleat device, and wherein the target band may be adjustably raised and lowered to position it at various heighths above the standard tennis net with which it is used.

Other objects and advantages of the invention will be apparent from the following detailed description of a preferred embodiment and from the accompanying drawings.

SUMMARY OF THE INVENTION

The invention resides in a tennis teaching aid providing a target band located at a variable heighth above the top of a standard net to encourage hitting balls over the net with a greater ball-to-net spacing than would otherwise be the case.

The invention more specifically resides in the aid consisting of two auxiliary posts adapted to be releasably connected to the standard net posts so as to extend upwardly from the net posts, and a target band assembly connectable at its opposite ends to the two auxiliary posts so as to stretched between said auxiliary posts directly above the top of the associated standard net.

The invention still further resides in various details of construction of the auxiliary net posts, of the target band assembly, of the means for releasably connecting the target band assembly to the auxiliary posts with variable tension, and of the means for varying the heighth of the target band.

DESCRIPTION OF THE PREFERRED EMBODIMENT

Figure 1:
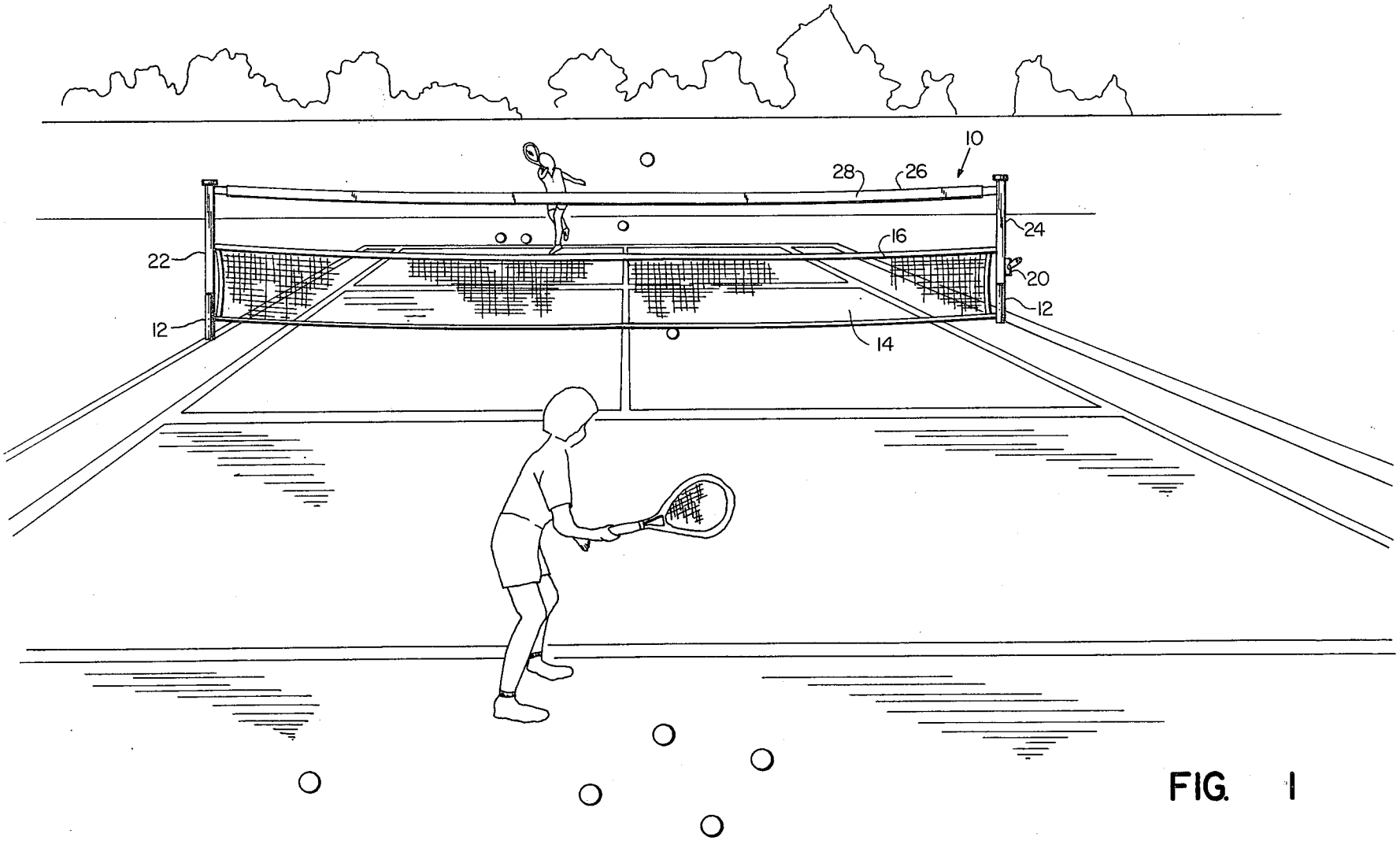
FIG. 1 is a perspective view showing a tennis teaching aid embodying this invention set up and in use on a standard tennis court.
Figure 2:
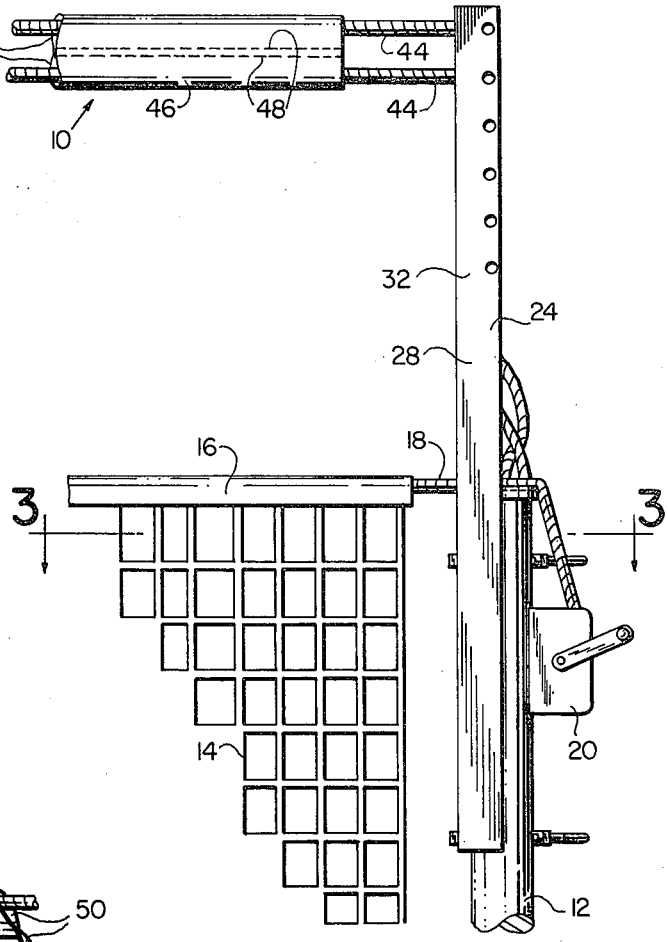
FIG. 2 is an elevational view showing the front side of the right-hand auxiliary post of FIG. 1, the front side being the side seen in FIG. 1.
Figure 4:
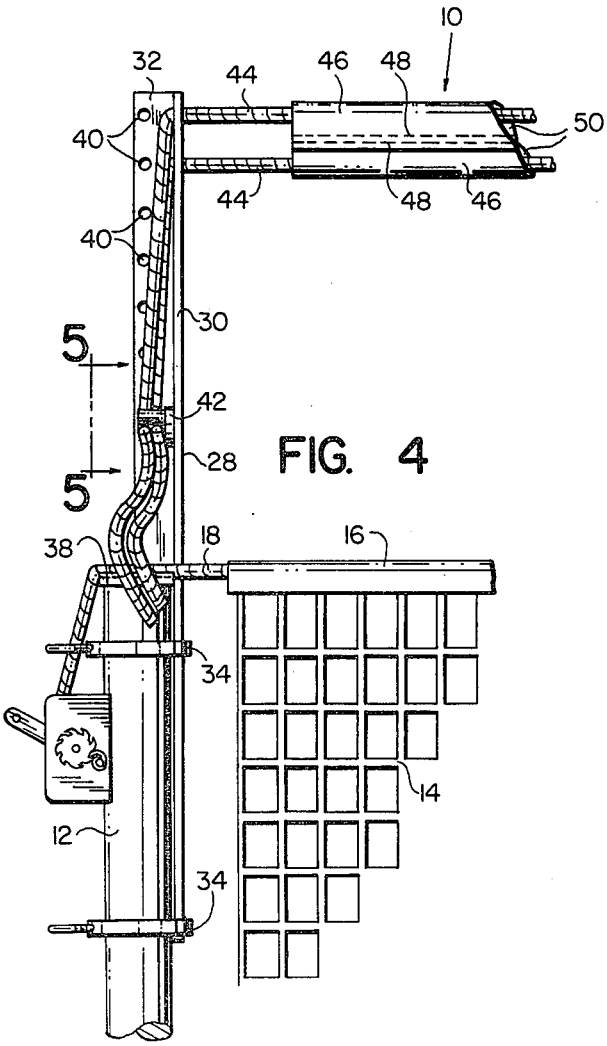
FIG. 4 is an elevational view showing the rear side of the auxiliary post of FIG. 2.
Figure 5:
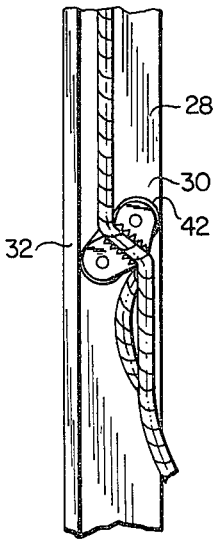
FIG. 5 is a fragmentary elevational view taken in the direction of the arrows 5—5 of FIG. 4.
Figure 6:
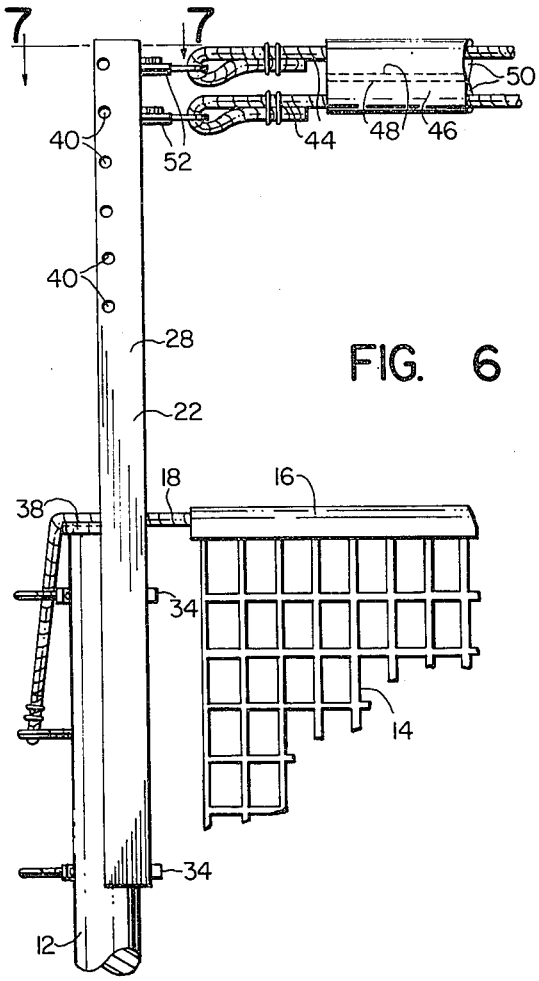
FIG. 6 is an elevational view showing the front side of the left auxiliary post of FIG. 1.

FIG. 1 shows two players on a tennis court equipped with a tennis teaching aid, indicated generally at 10, embodying the present invention. The court includes two standard net posts 12, 12 between which is stretched a standard tennis net 14 having a white top band or tape 16. A rope 18 extends through the top band 16 and, as shown in FIG. 6, at its left-hand end is fastened to the left net post 12. As shown best in FIG. 2, at its right-hand end the rope 18 is attached to the right-hand net post 12 through a standard net tensioning mechanism such as the illustrated crank and ratchet mechanism 20.

The teaching aid 10 of the invention consists essentially of two auxiliary posts 22 and 24, attached to the net posts 12, 12, and a target band assembly 26 stretched between the auxiliary posts 22 and 24 at some selected height above the top band 16 of the net 14. The auxiliary posts 22 and 24 extend vertically upwardly beyond the tops of the net posts 12, 12 and are releasably connected with the net posts so that the teaching aid may be quickly and easily set up and taken down. The net assembly at its opposite ends is releasably connected with the auxiliary posts at various selectable heighths and along the major portion of its length it includes a relatively wide white band 28 simulating the top band 16 of the net 14. The band 28 therefore serves as an auxiliary target encouraging balls to be hit above it and accordingly over the top band 16 of the net 14 with a greater ball-to-net spacing than would otherwise be the case. As mentioned previously this is useful as an aid in instruction and in practice to develop proper ground stroke technique and other abilities.

Figure 3:
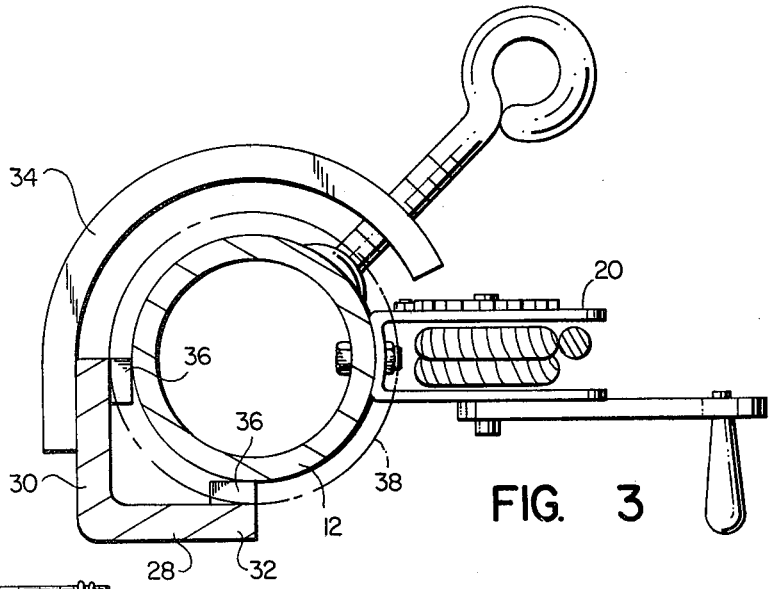
FIG. 3 is an enlarged transverse sectional view taken on the line 3—3 of FIG. 2.

The actual details of construction of the auxiliary posts 22 and 24 and of the target band assembly 26 may vary widely without departing from the broader aspects of the invention. In the illustrated case, however, the right-hand auxiliary post 24, as shown in FIGS. 2 to 5, consists of an elongated angle member 28 of aluminum, steel or other rigid material having two flanges 30 and 32. Welded to the lower end of the member 28 are two screw clamps 34, 34 which releasably hold the member to the end post 12. In the vicinity of each clamp 34 the member 28 has welded to the inside surfaces of its flanges 30 and 32 two small pads 36, 36 which directly engage the post 12, as shown in FIG. 3, and hold the member 28 a small distance radially outwardly from the post 12 to allow it to pass freely upwardly beyond the end cap 38, shown in phantom in FIG. 3, which is of slightly larger outside diameter than the post 12.

In its upper end portion the member 28 of the auxiliary post 24 has a plurality of vertically spaced openings 40, 40 in each of its flanges 30 and 32 for use with the ropes of the target band assembly 10 as hereinafter described. Fixed to the flange 30 below the holes 40, 40 is a marine jamb cleat 42 for use in holding and adjusting the tension of the ropes of the target band assembly.

Figure 7:
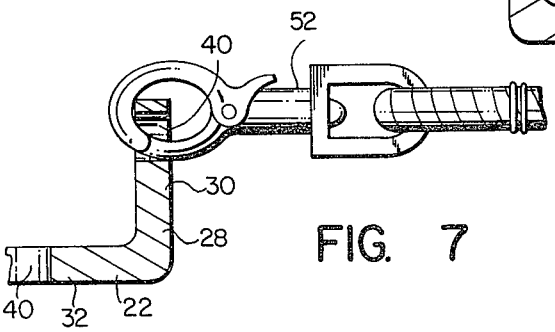
FIG. 7 is an enlarged transverse sectional view taken on the line 7—7 of FIG. 6.

The construction of the left auxiliary post 22 is similar to that of the right auxiliary post 24 except for not including a jamb cleat, and therefore the parts of the left post 22, as seen in FIGS. 6 and 7, have been given the same reference numerals as the corresponding parts of the auxiliary post 24 and need not be further described.

The target band assembly 10 comprises two ropes 44, 44 and a target band 46. The band 46 is of approximately the same length as the top band 16 of the net 14 and is made of a strip of sheet material having its two longitudinal edge portions folded inwardly and sewn to the body of the strip, as along the lines 48, 48, to form two elongated pockets 50, 50 through which the ropes extend. At its left-hand end, as seen in FIGS. 6 and 7, each rope 44 is connected to a snap hook 52 which is releasably engageable with the auxiliary post 22 through a selected one of its openings 40. Therefore, by manually snapping the hooks 52, 52 into any selected pair of openings 40, 40 in one of the flanges 30 or 32 the heighth of the left-hand end of the target assembly may be varied. It should also be noted that to which flange 30 or 32 of the auxiliary post 22 the snap hooks 52, 52 are fastened depends on the angular orientation of its post member 28 relative to the net post 12. In the figures, both post members 28, 28 of the two auxiliary posts 22 and 24 are shown positioned for connection of the target assembly to the flanges 30, 30, but the auxiliary posts could also be clamped to the end posts in some other angular position around the end posts 12, 12 so as to make one or both of the other flanges 32, 32 better positioned for connection to the target assembly.

At the right-hand end of the band assembly 10 the ropes 42, 42 pass through associated openings 40, 40 in the auxiliary post 24 and are passed downwardly to and through the jamb cleat 42. Therefore, the heighth of the right-hand end of the band assembly may be readily adjusted by selectively varying holes 40, 40 through which the ropes pass, and the tension of the ropes may be readily adjusted by pulling downwardly on those portions of the ropes which extend downwardly beyond the jamb cleat, and after the desired tension is reached the jamb cleat will thereafter hold the ropes with such tension.

The dimensions of the auxiliary posts 22 and 24 may, of course, vary slightly without departing from the invention, but in an exemplary embodiment, each post member 28, 28 is four feet, eight inches long with each flange 30 and 32 being $1\frac{3}{4}$ inches wide and 3/16 inch thick. Also, each flange 30 and 32 has six holes 40, 40 formed therein with the holes being $\frac{3}{8}$ of an inch in diameter and with the holes being spaced four inches apart starting $\frac{3}{8}$ of an inch from the top of the post and $\frac{3}{8}$ of an inch in from the outer edge of the flange. In use, each post member 28 is clamped to its associated net post 12 so that the post extends thirty-four inches above the top of the net post.

We claim:

1. A tennis teaching aid for use on a tennis court having two net posts between which a standard net is stretched, said teaching aid comprising:

two auxiliary posts attachable respectively to said two net posts so as to extend vertically upwardly from said net posts, and a target band assembly adapted for connection at its opposite ends to said two auxiliary posts so as to stretch between said posts in vertically spaced relation to the top of said standard net stretched between said net posts, said target band assembly including at least one rope adapted to extend between and to be connected at its opposite ends to said auxiliary posts, and a target band attached to said rope and of a length approximately equal to the length of the said standard net stretched between said net posts, means for releasably connecting one end of said rope to one of said auxiliary posts, and means carried by the other of said auxiliary posts for releasably receiving the other end of said rope and for holding said end in a tightened condition with adjustable tension, each of said auxiliary posts having a plurality of vertically spaced openings extending therethrough, said means for releasably connecting one end of said rope to one of said auxiliary posts including a snap hook connected to said one rope end and selectively receivable in any one of said openings of said one auxiliary post, and said means for releasably receiving the other end of said rope and for holding it in a tightened condition with adjustable tension comprising a jamb cleat device carried by said other auxiliary post below said vertically spaced openings therein so that said other end of said rope may be inserted through any selected one of said openings in said other auxiliary post to determine the heighth of said other end and may be received by said jamb cleat device to hold it in tightened condition.

2. A tennis teaching aid for use on a tennis court having two net posts between which a standard net is stretched, said teaching aid comprising:

two auxiliary posts attachable respectively to said two net posts so as to extend vertically upwardly from said net posts, and a target band assembly adapted for connection at its opposite ends to said two auxiliary posts so as to stretch between said posts in vertically spaced relation to the top of said standard net stretched between said net posts, said target band assembly comprising two ropes adapted to extend between said two auxiliary posts and to be releasably connected at each of their ends to said two auxiliary posts, and a target band consisting of an elongated strip of material folded upon itself along each longitudinal edge and sewn longitudinally to provide two longitudinally extending pockets along each edge of said band which receive said two ropes, and one of said auxiliary posts having a series of vertically spaced openings therein, each of said two ropes at the end thereof associated with said one auxiliary post having connected thereto a snap hook for releasably engaging one of said openings of said one auxiliary post, the other of said auxiliary posts also having a series of vertically spaced openings therein for receiving said ropes and to determine the height of said target band assembly and said other of said auxiliary posts also having a means fixed thereto for releasably receiving and holding the associated ends of said two ropes in a tightened condition with adjustable tension after said ropes are inserted through said openings.

3. A tennis teaching aid as defined in claim 2 further characterized by said means for receiving and holding said associated ends of said ropes in a tightened condition being a jamb cleat device carried by said other auxiliary post.

* * * * *